US008781385B2

(12) United States Patent
Ueyama et al.

(10) Patent No.: US 8,781,385 B2
(45) Date of Patent: Jul. 15, 2014

(54) MEDIUM-FEEDING DEVICE AND RECORDING DEVICE

(75) Inventors: Naohiro Ueyama, Nagano (JP); Kenji Yanagishita, Nagano (JP); Hiroshi Shiohara, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 280 days.

(21) Appl. No.: 13/039,443

(22) Filed: Mar. 3, 2011

(65) Prior Publication Data

US 2011/0236113 A1 Sep. 29, 2011

(30) Foreign Application Priority Data

Mar. 23, 2010 (JP) ..... 2010-066001

(51) Int. Cl.
*B65H 3/46* (2006.01)

(52) U.S. Cl.
CPC ..... *B65H 3/46* (2013.01)
USPC ..... 399/388; 271/121

(58) Field of Classification Search
CPC ..... B65H 3/46; B65H 3/56
USPC ..... 399/388; 271/121–124
See application file for complete search history.

(56) References Cited

U.S. PATENT DOCUMENTS

| | | | | |
|---|---|---|---|---|
| 5,316,285 | A * | 5/1994 | Olson et al. | 271/122 |
| 5,655,762 | A * | 8/1997 | Yergenson | 271/121 |
| 7,267,334 | B2 * | 9/2007 | Koh et al. | 271/121 |
| 7,500,666 | B2 * | 3/2009 | Yanagishita | 271/121 |
| 7,720,429 | B2 * | 5/2010 | Lim | 399/388 |
| 2002/0175462 | A1 * | 11/2002 | Sonoda et al. | 271/121 |
| 2009/0283956 | A1 | 11/2009 | Yanagishita | |

FOREIGN PATENT DOCUMENTS

| | | | | |
|---|---|---|---|---|
| JP | 2001-019191 | A | 1/2001 | |
| JP | 2003341867 | A * | 12/2003 | B65H 3/46 |
| JP | 2004299899 | A * | 10/2004 | B65H 3/46 |
| JP | 2005272063 | A * | 10/2005 | B65H 3/46 |
| JP | 2006117362 | A * | 5/2006 | B65H 3/64 |
| JP | 2006117387 | A * | 5/2006 | B65H 3/46 |
| JP | 2007099422 | A * | 4/2007 | B65H 3/46 |
| JP | 2007197182 | A * | 8/2007 | B65H 3/46 |
| JP | 2008120592 | A * | 5/2008 | B65H 3/46 |
| JP | 2009143688 | A * | 7/2009 | B65H 3/06 |
| JP | 2009-280292 | A | 12/2009 | |

* cited by examiner

*Primary Examiner* — Nguyen Ha
(74) *Attorney, Agent, or Firm* — Global IP Counselors, LLP

(57) ABSTRACT

A medium-feeding device includes: a feeding unit for feeding a fed medium in a feed direction, a first separating unit provided downstream in the feed direction relative to the feeding unit to separate a multi-fed medium; a second separating unit provided downstream relative to the first separating unit to switch between a compressive holding state in which the multi-fed medium is compressively held, and a released state in which compressive holding is released; and a contact part provided downstream relative to the second separating unit to switch between a protruding state and a retracted state relative to a feed path for guiding the fed medium. The medium-feeding device has a first separating mode, in which separation of the multi-fed medium is performed using the first separating unit, the second separating unit, and the contact part, and a second separating mode, in which separation is performed using the first separating unit.

12 Claims, 7 Drawing Sheets

MEDIUM-FEEDING DEVICE AND RECORDING DEVICE

CROSS-REFERENCE TO RELATED APPLICATIONS

This application claims priority to Japanese Patent Application No. 2010-066001 filed on Mar. 23, 2010. The entire disclosure of Japanese Patent Application No. 2010-066001 is hereby incorporated herein by reference.

BACKGROUND

1. Technical Field

The present invention relates to a medium-feeding device and a recording device comprising the medium-feeding device, the medium-feeding device comprising feeding unit for feeding a fed medium in a feed direction; first separating unit provided downstream in the feed direction relative to the feeding unit, the first separating unit being capable of separating a fed medium that has been multi-fed; and second separating unit provided downstream relative to the first separating unit, the second separating unit being for compressively holding the fed medium that has been fed, thereby separating a fed medium that has been multi-fed in an instance in which the fed medium has been multi-fed.

In the present application, the recording device refers to an ink-jet printer, a wire dot printer, a laser printer, a line printer, a photocopier, a fax machine, or a similar type of device.

2. Related Art

Conventionally, a medium-feeding device provided to a recording device comprises first separating unit, second separating unit, and a rib, as shown in Japanese Laid-Open Patent Application Publication No. 2009-280292. The first separating unit has a surface that is inclined, with respect to a side view, relative to an orientation of paper placed as a fed medium. A front edge of the paper comes into contact with the surface, whereby the fed medium that has been multi-fed can be separated. The second separating unit is provided downstream in a feed direction relative to the first separating unit.

Specifically, there is provided a roller for driving, and a retard roller requiring a predetermined load in order to rotate. The second separating unit is configured so that in an instance in which a front edge of a plurality of sheets of paper passes through the first separating unit, the second separating unit compressively holds the front edge of the sheets of paper. The medium-feeding device is configured so that, in such an instance, the retard roller prevents a paper sheet disposed on a side towards the retard roller from moving, and so that, meanwhile, a paper sheet disposed on a side towards the driving roller is fed further downstream by the driving roller. The rib is provided so as to be secured in place further downstream relative to the retard roller.

The medium-feeding device is provided so that the sheets of paper are separated by the second separating unit, and a front edge of a paper sheet nearest to the driving roller passes the rib. The medium-feeding device is configured so that the retard roller then moves in a direction away from the driving roller. The medium-feeding device is configured so that the rib comes into contact with a front edge of an unwanted paper sheet that has been separated by the second separating unit, and the unwanted paper sheet is prevented from moving downstream in the feed direction.

SUMMARY

However, the retard roller and the rib were provided in a feed path to a side disposed opposite a surface of the paper sheet on which a recording is made (i.e., a front surface). A risk is presented in that the retard roller will press against the surface of the paper sheet on which a recording is made (i.e., the front surface), damaging or fouling the surface of the paper sheet on which a recording is made (i.e., the front sheet). For example, in an instance in which the paper sheet is a non-glossy "matte sheet," there is a risk of rubber dust from the retard roller adhering to the recording surface of the sheet of paper, harming the quality of the recording surface. There is also a risk of the rib coming into concentrated contact with the surface of the sheet of paper on which a recording is made (i.e., the front surface), thereby causing damage to the surface of the sheet of paper on which a recording is made (i.e., the front surface).

The paper sheets can be separated using the first separating unit and not the second separating unit; however, since the rib is provided securely in place, it is not possible to feed a front edge of a paper sheet further downstream of the rib without using the second separating unit.

With the foregoing circumstances in view, an object of the present invention is to provide a medium-feeding device in which damage or fouling caused by separating means on a surface of a fed medium is taken into consideration, and a recording device provided with the medium-feeding device.

In order to achieve the above-mentioned object, a medium-feeding device according to a first aspect of the present invention includes a feeding unit, a first separating unit, a second separating unit and a contact part. The feeding unit is configured to feed a fed medium in a feed direction. The first separating unit is provided downstream in the feed direction relative to the feeding unit. The first separating unit is configured to separate a multi-fed medium that has been multi-fed. The second separating unit is provided downstream relative to the first separating unit. The second separating unit is configured to switch between a compressive holding state in which the multi-fed medium is compressively held to separate the multi-fed medium that has been multi-fed, and a released state in which compressive holding is released. The contact part is provided downstream relative to the second separating unit, the contact part being configured to switch between a protruding state relative to a feed path for guiding the fed medium in which the contact part coming into contact against a front edge of the fed medium that has been separated by the second separating unit to restrict movement of the fed medium towards downstream, and a retracted state relative to the feed path. The medium-feeding device is configured to switch between a first separation mode, in which separation of the multi-fed medium is performed using the first separating unit, the second separating unit, and the contact part, and a second separating mode, in which separation of the multi-fed medium is performed using the first separating unit without using the second separating unit and the contact part.

According to the first aspect of the present invention, it is possible to switch to the second separating mode. In such an instance, the contact part is in the retracted state, and it is therefore possible to feed the fed medium. Specifically, in an instance in which the second separating mode is enabled, the second separating unit is in the released state, and the contact part is in the retracted state. As a result, there is no risk of the fed medium catching on the contact part, thereby resulting in a state in which the fed medium cannot be fed. Further specifically, even in an instance in which separation is performed using only the first separating unit, feeding of the fed medium can be performed in a reliable manner.

In an instance in which the second separating mode is enabled so that the fed medium is fed without using the second separating unit, there is no risk of the second separating unit damaging or fouling a surface of the fed medium. Specifically, there is no risk of, e.g., rubber dust from a roller adhering to the surface of the fed medium. Also, there is no risk of the contact part causing damage on the surface of the fed medium.

Also, in an instance of the second separating mode, the fed medium is not subjected to a compressive holding force applied by the second separating unit; therefore, load for transporting the fed medium is correspondingly smaller, and the feed accuracy can be increased. Specifically, the medium is not subjected to the compressive holding force, and feeding of the fed medium can be performed in a correspondingly straightforward manner. It then becomes possible to reduce skewing, in which the orientation of the fed medium becomes inclined relative to the feed direction.

In the instance of the second separating mode, there is no need to perform an operation in which the second separating unit is switched from the compressively held state to the released state every time the fed medium is fed. An operation of feeding the fed medium can be performed in a correspondingly smoother manner. For example, the speed of feeding the fed medium can be increased. Also, the throughput, which is the time between a start of a feed of a fed medium and a start of a feed of a following fed medium, can be made shorter.

A medium-feeding device according to a second aspect of the present invention is the medium-feeding device according to the first aspect, wherein the first separating mode includes a first state, in which the second separating unit is in the compressive holding state and the contact part is in the protruding state, and a second state, in which the second separating unit is in the released state and the contact part is in the protruding state, the second separating mode includes a third state, in which the second separating unit is in the released state and the contact part is in the retracted state, and the medium-feeding device is configured to switch between the first state, the second state and the third state.

According to the second aspect of the present invention, an operation and effect similar to those according to the first aspect can be obtained.

A medium-feeding device according to a third aspect of the present invention is the medium-feeding device according to the first aspect, further including a cam mechanism configured to switch between the protruding state and the retracted state of the contact part, the cam mechanism being configured to selectively maintain the protruding state of the contact part.

According to the third aspect of the present invention, in addition to the resulting operation and effect being similar to those according to the second aspect, there is no risk of the contact part being pushed downwards due to the stiffness or the weight of the fed medium passing the contact part when the contact part is in the protruding state. Therefore, it is possible for the contact part to reliably prevent movement of the fed medium that has been separated by the second separating unit in an instance in which the fed medium has been multi-fed.

A medium-feeding device according to a fourth aspect of the present invention is the medium-feeding device according to any of the first through third aspects, wherein the second separating unit has a driving roller configured to drive, and a retard roller configured to perform an approaching/retracting movement relative to the driving roller, the retard roller requiring a predetermined load in order to rotate, the contact part is disposed on a side of the feed path on which the retard roller is provided with respect to the fed medium, and a section of the feed path between the feeding unit and the contact part has a curved configuration so that the side on which the retard roller and the contact part are provided is disposed at an outside of an arc.

According to the fourth aspect of the present invention, in addition to the resulting operation and effect being similar to those according to any of the first through third aspects, the contact part is capable of preventing movement of the fed medium that has been separated by the second separating unit in a more reliable manner.

A recording device according to a fifth aspect of the present invention includes a medium-feeding unit including the medium-feeding device according to any of the first to fourth aspects to feed a recording medium in the feed direction, and a recording part configured to perform recording, using a recording head, on the recording medium that has been fed by the medium-feeding unit.

According to the fifth aspect of the present invention, the medium-feeding unit is provided with the medium-feeding device according to any of the first through fourth aspects. Therefore, in the recording device, it is possible to obtain a similar operation and effect as those according to any of the first through fourth aspects.

BRIEF DESCRIPTION OF THE DRAWINGS

Referring now to the attached drawings which form a part of this original disclosure.

DETAILED DESCRIPTION OF EXEMPLARY EMBODIMENTS

An embodiment of the present invention will now be described with reference to the accompanying drawings.

Figure 1:
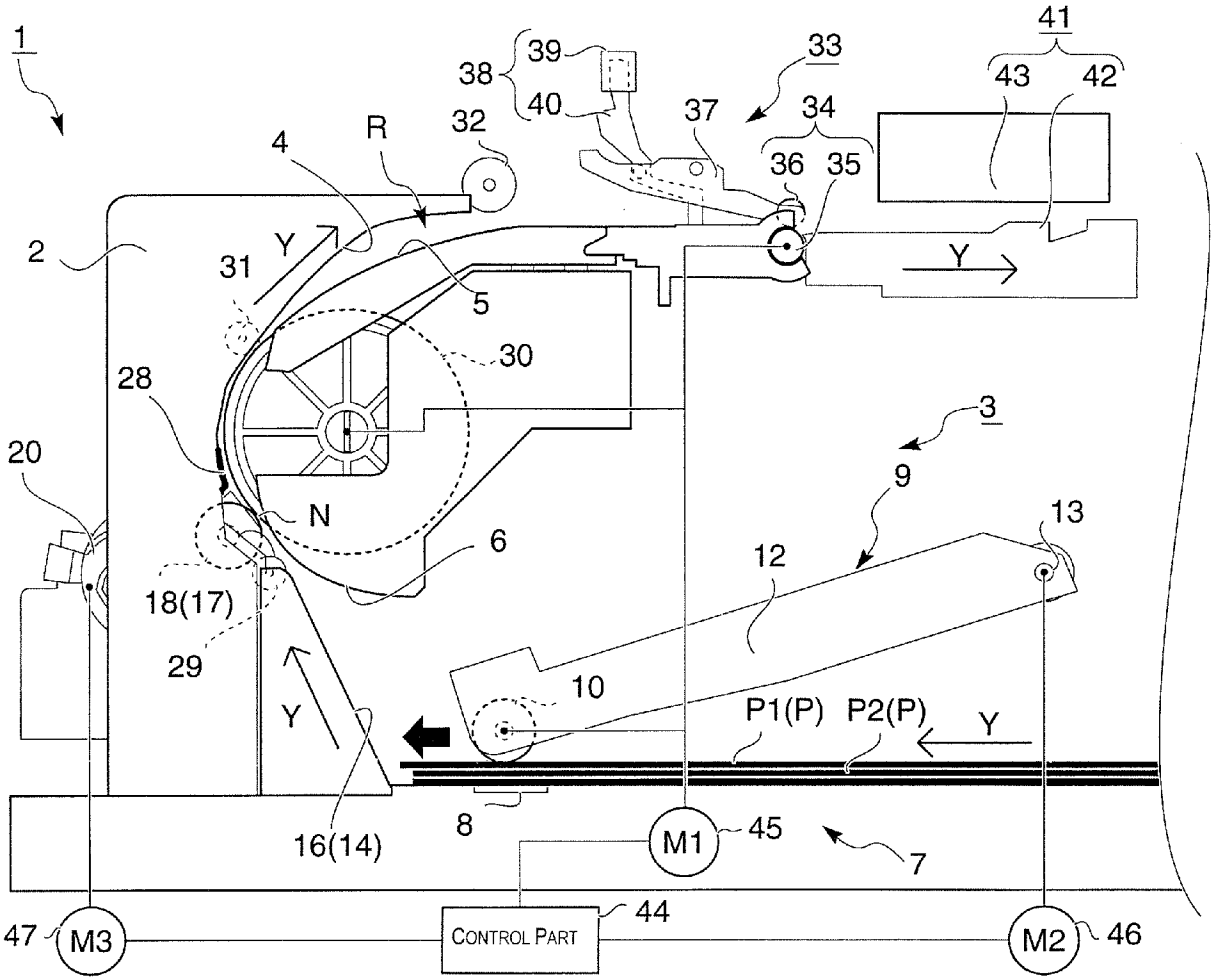
FIG. 1 is a side view showing an overview of the entirety of a printer according to the present invention.

FIG. 1 is a side view of an operation during pickup in an interior of an inkjet printer 1 ("printer" hereafter) used as an example of a "recording device" or a "liquid ejection device".

The meaning of the term "liquid ejection device" is not limited to an ink-jet recording device, photocopier, or fax machine in which ink is ejected from a recording head 43, which is a liquid-ejecting head, onto a recording paper or another recording material and recording is performed on the recording material. The term also includes a device for ejecting, instead of the ink, a liquid having a specific usage from a liquid-ejecting head corresponding to the recording head 43 onto an ejection target material corresponding to the recording material.

Examples of the liquid-ejecting head include, other than the recording head mentioned above, a color material-ejecting head used in manufacturing a color filter for a liquid crystal display or a similar device; an electrode material (i.e., electroconductive paste)-ejecting head used for forming an electrode in an organic EL display, a field emission display (FED), or a similar device; a bioorganic-matter-ejecting head used in manufacture of biochips; and a test sample-ejecting head for ejecting a test sample, used as a precision pipette.

As shown in FIG. 1, the printer 1 has medium-feeding unit 3, a conveying part 33, a recording part 41, and a discharging part (not shown). The medium-feeding unit 3 has a pickup part 9; first separating unit 14, which is a backup separating part; and second separating unit 17, which is a main separating part. The pickup part 9 is provided so as to be capable of picking up a paper sheet P placed on a cassette part 7 and feeding the paper sheet P downstream of a feed direction.

Specifically, the pickup part 9 has a pickup roller 10 driven by power from a first motor 45, which is an example of a drive source; and an arm part 12 for holding the pickup roller 10 and undergoing a swinging motion so as to be pivoted on an arm shaft 13. The pickup roller 10 is urged in a direction approaching the paper sheet P by urging means (not shown). A configuration is provided whereby pickup retracting means (not shown) transmits power from a second motor 46, causes the arm part 12 to swing, and moves the pickup roller 10 in a direction away from the paper sheet P that has been placed. In other words, a pickup and release operation is performed.

A pad part 8, formed from a material having a high friction coefficient relative to the paper sheet P, is provided on a placement surface of the cassette part 7, at a position opposite the pickup roller 10.

The first separating unit 14 has an inclined surface 16 for performing so-called bank separation. An operation will be described further below.

The second separating unit 17 is provided downstream in the feed direction relative to the first separating unit 14. The second separating unit 17 has a retard roller 18 that rotates under a predetermined load. The retard roller 18 is provided so as to form a counterpart with an intermediate driving roller 30 driven by power from a first motor 45. The retard roller 18 is provided so as to be capable of being moved by a first swing mechanism 20 so as to approach/retract relative to the intermediate driving roller 30. Specifically, the retard roller 18 is held by a retard holder 19 (see FIGS. 2 through 7), and configured so as to undergo a swinging motion, pivoted on a first swinging shaft 22 (see FIGS. 3, 5, and 7).

One end of a spring 23 (see FIGS. 3, 5, and 7) engages with a base body part 2, and another end of the spring 23 engages with a free end side of the retard holder 19. Therefore, it is possible to subject the retard roller 18 to a spring force acting in a direction approaching the intermediate driving roller 30. The first swing mechanism 20 has a first cam part (not shown) driven by power from a third motor 47 as means for causing the retard roller 18 to move away from the intermediate driving roller 30 against the force of the spring 23. The first cam part is provided so as to engage with the retard holder 19 and form a cam mechanism, so as to be capable of causing the retard roller 18 to move away from the intermediate driving roller 30 via the retard holder 19.

A first assist roller 29 for undergoing driven rotation is provided between the inclined surface 16 and the retard roller 18. The first assist roller 29 is provided so as to be capable of guiding a front edge of the paper sheet P, which has passed the inclined surface 16, towards a nip point N between the retard roller 18 and the intermediate driving roller 30 in a smooth manner.

Also, a contact part 28 described further below is provided downstream in the feed direction relative to the nip point N between the retard roller 18 and the intermediate driving roller 30. The contact part 28 is configured so as to be capable of being caused to undergo a swinging motion by a second swing mechanism 24 (see FIGS. 3, 5, and 7).

A second assist roller 31, rotatably held to the base body part 2 so as to be tangential to the intermediate driving roller 30, is provided further downstream in the feed direction. A third assist roller 32 is provided even further downstream in the feed direction.

A feed path R of the paper sheet P describes a U-shape from the pickup part 9 to the conveying part 33 when viewed from a side. Specifically, a U-shaped external paper guide part 4 for guiding the paper sheet P from an outside of the U-shape; an internal paper guide part 5 for guiding from an inside; the inclined surface 16; and an entrapment-preventing part 6 form the U-shaped feed path R. The entrapment-preventing part 6 is provided so as to prevent the intermediate driving roller 30 from coming into contact with, and entrapping, a paper sheet P2 in a state in which a front edge of the paper sheet P2, which has been separated by the second separating unit 17, is in contact against the contact part 28.

Therefore, the first through third assist rollers 29, 31, 32 make it possible to reduce friction resistance generated between the paper sheet P and the U-shaped external paper guide part 4. It is accordingly possible to feed the paper sheet P to the conveying part 33, further downstream in the feed direction, in a smooth manner.

The conveying part 33 has a conveying roller pair 34 for conveying the paper sheet P. The conveying roller pair 34 has a conveying driving roller 35, which is driven by power from the first motor 45; and a conveying driven roller 36, which undergoes driven rotation. Of the two conveying rollers, the conveying driven roller 36 is held by a driven roller holder 37 so as to be capable of rotating.

The driven roller holder 37 presses the conveying driven roller 36 against the conveying driving roller 35 through urging means (not shown). A paper detector 38 for detecting the presence or absence of the paper sheet P is provided in a vicinity of a position upstream in the feed direction Y relative to the conveying roller pair 34. Specifically, the paper detector 38 has a swingable paper detection lever 40 and a sensor part 39. The paper detector 38 is configured so as to be switched to an ON state by one end of the paper detection lever 40 coming into contact with the paper sheet P and thereby made to swing, and another end of the paper detection lever 40 moving away from a position between a light-emitting part and a light-receiving part (not shown) of the sensor part 39.

The conveying part 33 is provided so as to be capable of conveying the paper sheet P to the recording part 41 provided downstream in the feed direction.

The recording part 41 has the recording head 43 for ejecting ink onto the paper sheet P and performing recording; and a medium support part 42 for supporting the paper sheet P from below, the medium support part 42 being disposed opposite the recording head 43.

A discharge roller of a discharging part (not shown) subsequently discharges the paper sheet P on which the recording has been made onto a discharge tray (not shown) on a front surface of the printer 1.

A control part 44 is configured so as to control the first through third motors 45, 46, 47.

The medium-feeding unit 3 according to the present embodiment comprises a first separating mode and a second separating mode as described further below, and is configured so as to be capable of switching between the first separating mode and the second separating mode.

Here, the first separating mode refers to a mode in which separation is performed using the first separating unit 14, the second separating unit 17, and the contact part 28. The second separating mode refers to a mode in which separation is performed using the first separating unit 14 only, without using the second separating unit 17 or the contact part 28.

In the first separating mode, the second separating unit 17 has a first state and a second state, it being possible to switch between the first state and the second state.

The first state refers to a state in which the contact part 28 protrudes relative to the feed path R, and the retard roller 18 protrudes relative to the feed path R and is in contact with the intermediate driving roller 30, as described further below (see FIGS. 2 and 3).

The second state refers to a state in which the contact part 28 protrudes relative to the feed path R, and the retard roller 18 does not protrude relative to the feed path R and is separated from the intermediate driving roller 30, as described further below (see FIGS. 4 and 5).

In the second separating mode, the second separating unit 17 and the contact part 28 are configured so as to be in a third state.

The third state refers to a state in which the contact part 28 is not protruding relative to the feed path R, while the retard roller 18 does not protrude relative to the feed path R, and is separated from the intermediate driving roller 30, as described further below (see FIGS. 6 and 7).

First Separating Mode

Figure 2:
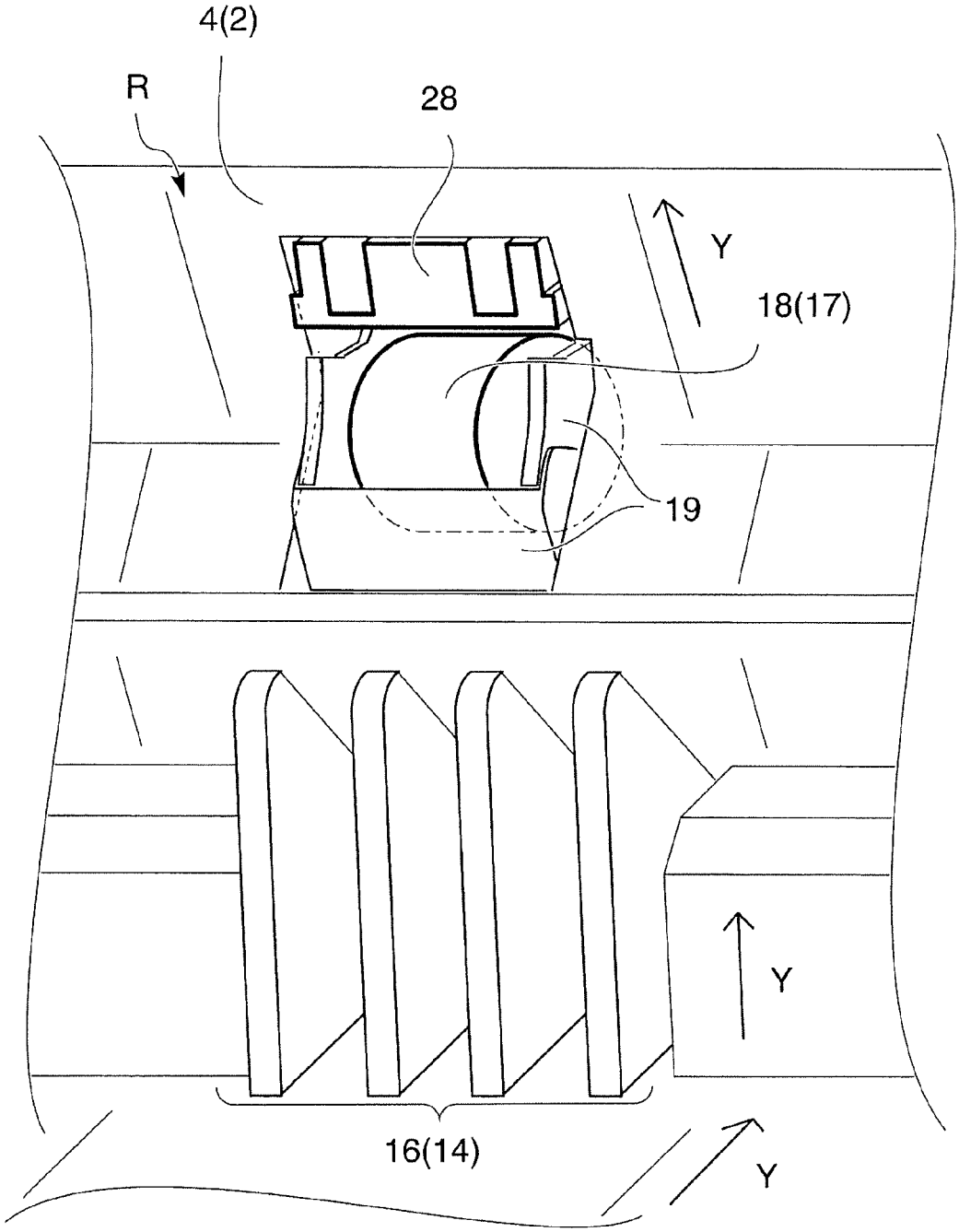
FIG. 2 is a perspective view showing a state of the second separating unit and the contact part (first separating mode, first state)

FIG. 2 is a perspective view showing a state of the second separating unit and the contact part in the first state according to the present invention. FIG. 3 is a side view showing a state of the second separating unit and the contact part in the first state according to the present invention.

In FIG. 2, the intermediate driving roller is not depicted, so that the position of the retard roller can be more easily understood.

Figure 3:
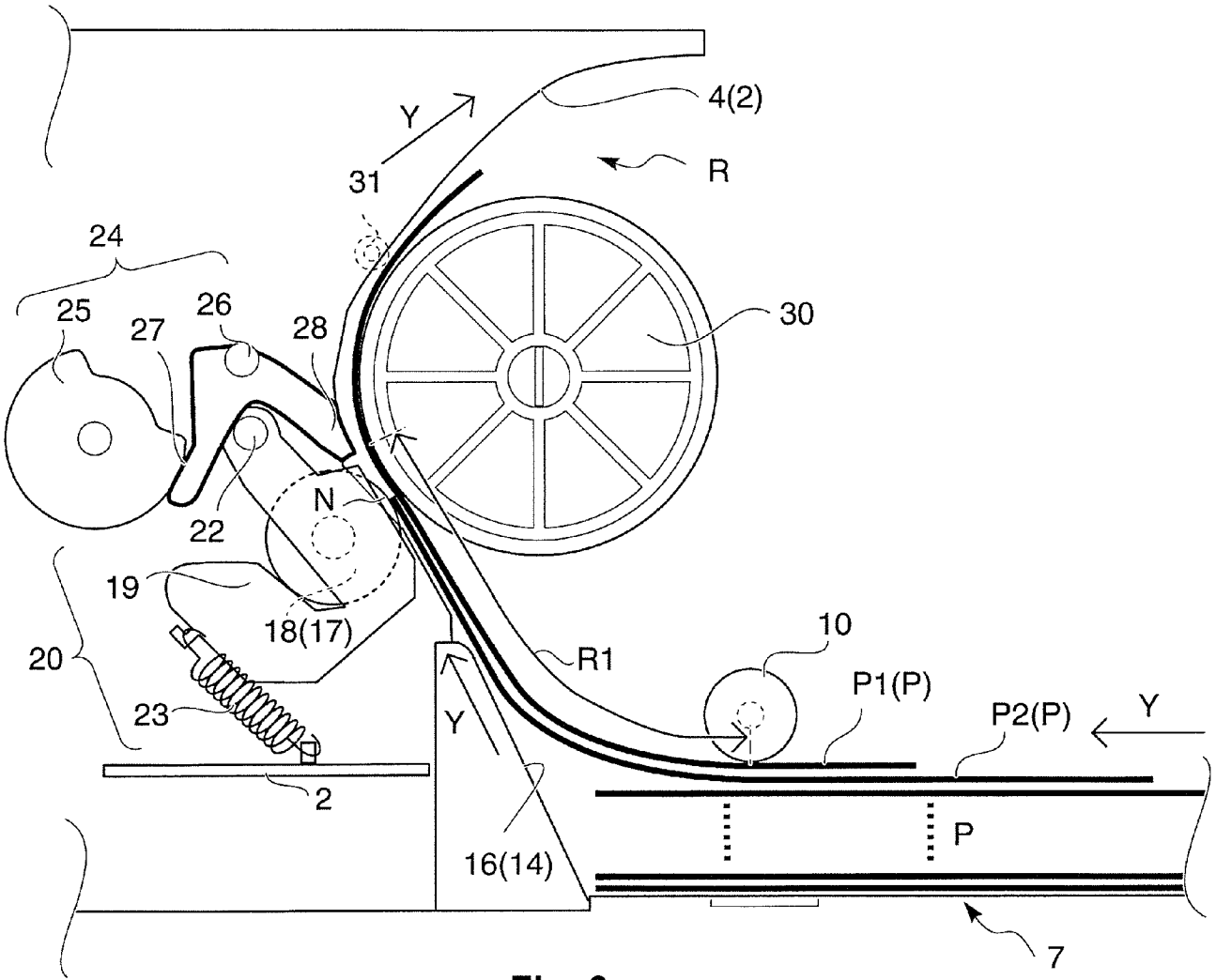
FIG. 3 is a side view showing a state of the second separating unit and the contact part (first separating mode, first state)

As shown in FIGS. 2 and 3, the contact part 28 and the retard roller 18 protrude relative to the feed path R. The retard roller 18 is in contact with the intermediate driving roller 30.

The retard roller 18 is held by the retard holder 19. The retard roller 18 is provided so that a friction force is generated between a torsion coil spring or a similar component and a shaft, and is configured so as to rotate so as to require a predetermined load. The retard holder 19 is provided so as to undergo a swinging motion centered on a first swing shaft 22. One end of the spring 23 engages with the retard holder 19 and another end of the spring 23 engages with the base body part 2.

The retard holder 19 is thereby configured so as to be subjected to a force that acts in a direction of the retard roller 18 approaching the intermediate driving roller 30. The retard holder 19 is configured so that the first cam part (not shown) is able to come into contact with a part of the retard holder 19 and cause the retard holder 19 to swing in a direction such that the retard roller 18 separates from the intermediate driving roller 30 against the force of the spring 23. In other words, the retard holder 19 is provided so as to be capable of causing the retard roller 18 to advance or retract relative to the feed path R.

The contact part 28 is configured so that the second swing mechanism 24 causes the contact part 28 to swing about a second swing shaft 26. A cam follower part 27 is formed integrally with the contact part 28. A second cam part 25 comes into contact with the cam follower part 27, and the contact part 28 is thereby capable of swinging. Specifically, the second cam part 25 is provided so as to be capable of causing the contact part 28 to retract relative to the feed path R.

The second cam part 25 presses the cam follower part 27, thereby causing the contact part 28 to protrude relative to the feed path R. The second cam part 25 is provided so as to be capable of maintaining a state in which the contact part 28 is protruding relative to the feed path R.

This is to prevent the contact part 28 from being pushed in a retracting direction by an outer surface (i.e., a surface facing the retard roller) of a paper sheet P1 that is in an uppermost position and that comes into direct contact with the intermediate driving roller 30 in an instance in which multi-fed paper sheet P2 has been separated by the second separating unit 17.

In the present embodiment, the weight of the contact part 28 subjects the contact part 28 to a force acting to cause rotation in the clockwise direction in FIG. 3. The contact part 28 can be switched to a state of not protruding relative to the feed path R, where the force from a spring is not used. It shall be apparent that the contact part 28 may also be configured so that a force from a spring is used, as with the swinging motion of the retard holder 19. In such an instance, the force of the spring acts on the contact part 28 in a direction of causing a rotation in the clockwise direction in FIG. 3.

When the pickup roller 10 sends the paper sheet P downstream in the feed direction, there are instances in which individual front edges of a plurality of paper sheets P1, P2 climb along the inclined surface 16 of the first separating unit 14. In such an instance, the respective front edges of the paper sheets P1, P2 reach the nip point N at which the intermediate driving roller 30 and the retard roller 18 of the second separating unit 17 are tangent to each other. In such an instance, the second separating unit 17 is in the first state, and is therefore capable of separating the paper sheet P1 in the uppermost position and the paper sheets P2 at subsequent positions.

It is possible for only the paper sheet P1 in the uppermost position to be fed further downstream using the intermediate driving roller 30. Specifically, the front edge of only the paper sheet P1 is able to move beyond the contact part 28.

For the contact part 28 to operate, at least a section R1 of the feed path R formed so as to have a U-shape must be curved so that a side on which the retard roller 18 and the contact part 28 are provided is disposed at an outside of an arc, the section R1 starting from a position at which the pickup roller 10 comes into contact with the paper sheet P, and ending at the contact part 28.

Figure 4:
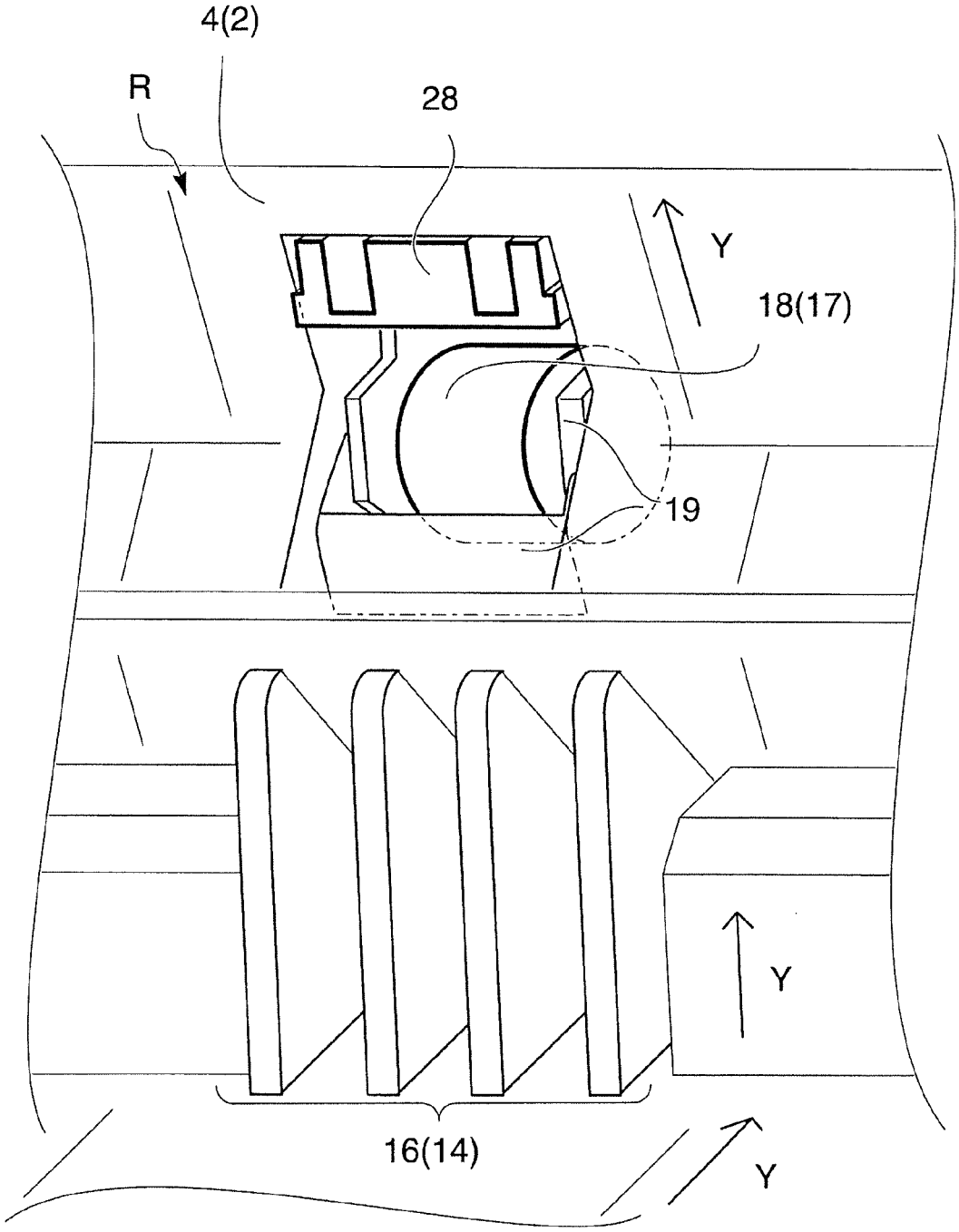
FIG. 4 is a perspective view showing a state of the second separating unit and the contact part (first separating mode, second state)
Figure 5:
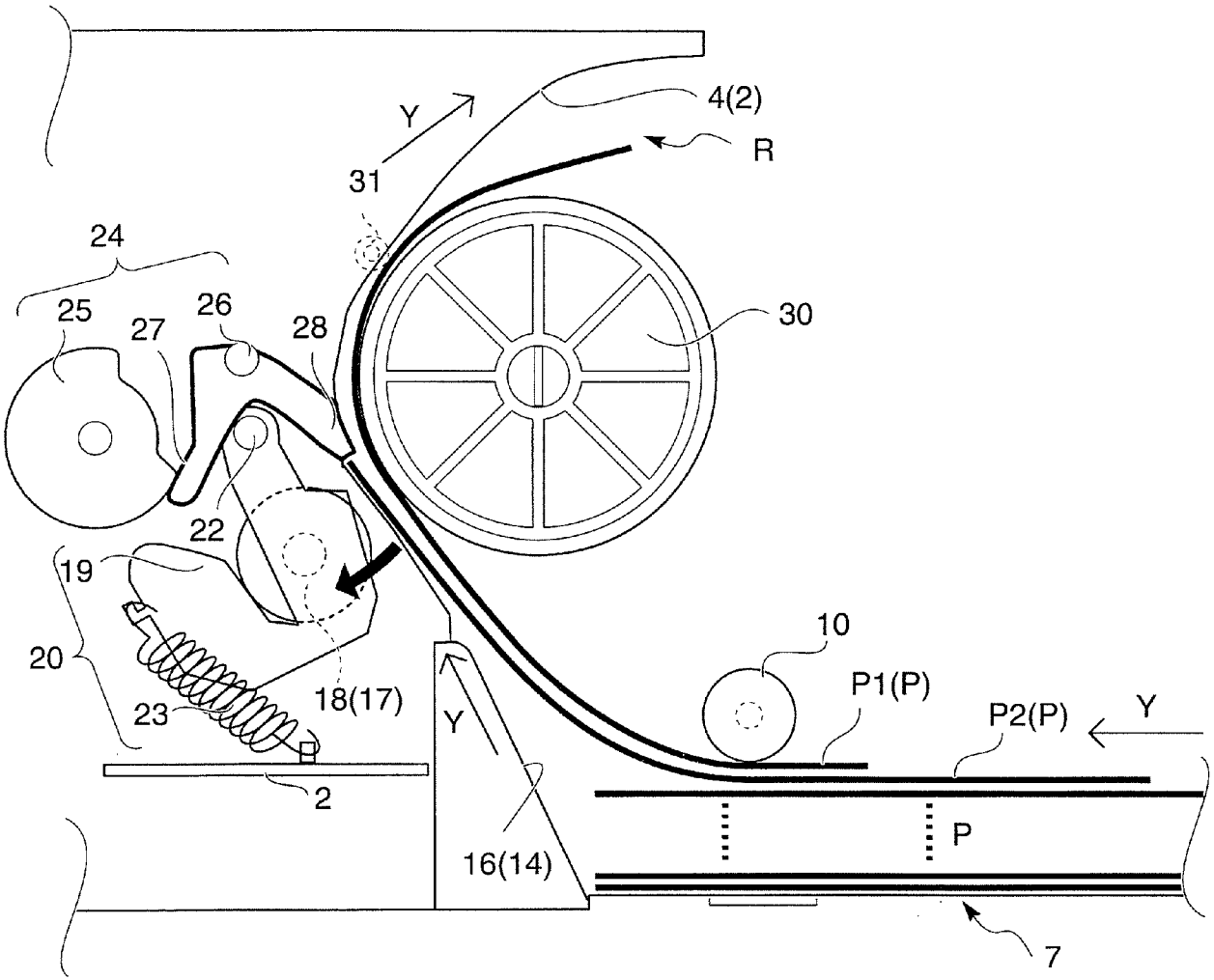
FIG. 5 is a side view showing a state of the second separating unit and the contact part (first separating mode, second state)

FIG. 4 is a perspective view showing a state of the second separating unit and the contact part in the second state according to the present invention. FIG. 5 is a side view showing a state of the second separating unit and the contact part in the second state according to the present invention.

In FIG. 4, the intermediate driving roller is not depicted, so that the position of the retard roller 18 can be more easily understood.

As shown in FIGS. 2 and 3, a configuration is provided so that when the front edge of the paper sheet P1 in the uppermost position passes the contact part 28, the first state switches to the second state.

Whether or not the front edge of the paper sheet P1 has passed the contact part 28 can be judged using a sensor (not shown) for detecting the paper sheet P, provided downstream of the contact part 28. The paper detector 38 may also be used. Also, a decision can be made from the amount by which the pickup roller 10 and the intermediate driving roller 30 have been driven.

"Back tension" results from the load of the retard roller 18 when the paper sheet P2 that has been multi-fed has been separated, and a reason for making a switch to the second state is to eliminate such back tension. Another reason is to prevent wear of the retard roller 18. A further reason is to prevent a press mark from forming on the paper sheet P1 as a result of pressure applied by the retard roller 18.

A specific operation for switching to the second state will now be described.

The third motor 47 causes the first cam part (not shown) to rotate. Then, a force from the spring 23 causes the retard holder 19 to swing in a clockwise direction in FIG. 5. Therefore, the retard roller 18 can be made to move away from the intermediate driving roller 30. Specifically, it is possible to cancel a state in which the retard roller 18 and the intermediate driving roller 30 compressively hold the paper sheets P1, P2.

In such an instance, the third motor 47 also causes the second cam part 25 to rotate. The second cam part 25 is formed so as to hold the contact part 28 in a protruding state. The present embodiment is configured so that the third motor 47 causes both of the first cam part (not shown) and the second cam part 25. However, it shall be apparent that another possible configuration is one in which each of the cam parts is caused to rotate by separate motors.

Then, the paper sheet P1 is fed further downstream. In this instance, a front edge side of a subsequent paper sheet P2 and a rear edge side of the paper sheet P1 in the uppermost position come into contact with each other, thereby subjecting the subsequent paper sheet P2 to a force acting to feed the subsequent paper sheet P2 downstream. However, no problems are presented because the contact part 28 is in contact against the front edge of the subsequent paper sheet P2 and prevents the subsequent paper sheet P2 from moving downstream.

Then, the recording part 41 makes a recording on the paper sheet P1, and the paper sheet P1 is discharged at the discharging part. The pickup roller 10 then moves so as to retract. In such an instance, the weight of the paper sheet P2, whose movement has been prevented by the contact part 28, causes the paper sheet P2 to return to an original position on the cassette part.

No problems are presented even if the paper sheet P2 does not return. This is because the second state switches to the first state, thereby making it possible to then feed the paper sheet P2.

In order to continue feeding the paper sheet P, the second state switches to the first state. A switch to the first state can be performed by the third motor 47 causing the first cam part (not shown) and the second cam part 25 to rotate.

Then, the pickup roller 10 is caused to come into contact with the paper sheet P2(P) that is next in the uppermost position, on a placement part. Accordingly, the paper sheet P2 that is next in the uppermost position can be fed in a similar manner to the preceding paper sheet P1.

Second Separating Mode

Figure 6:
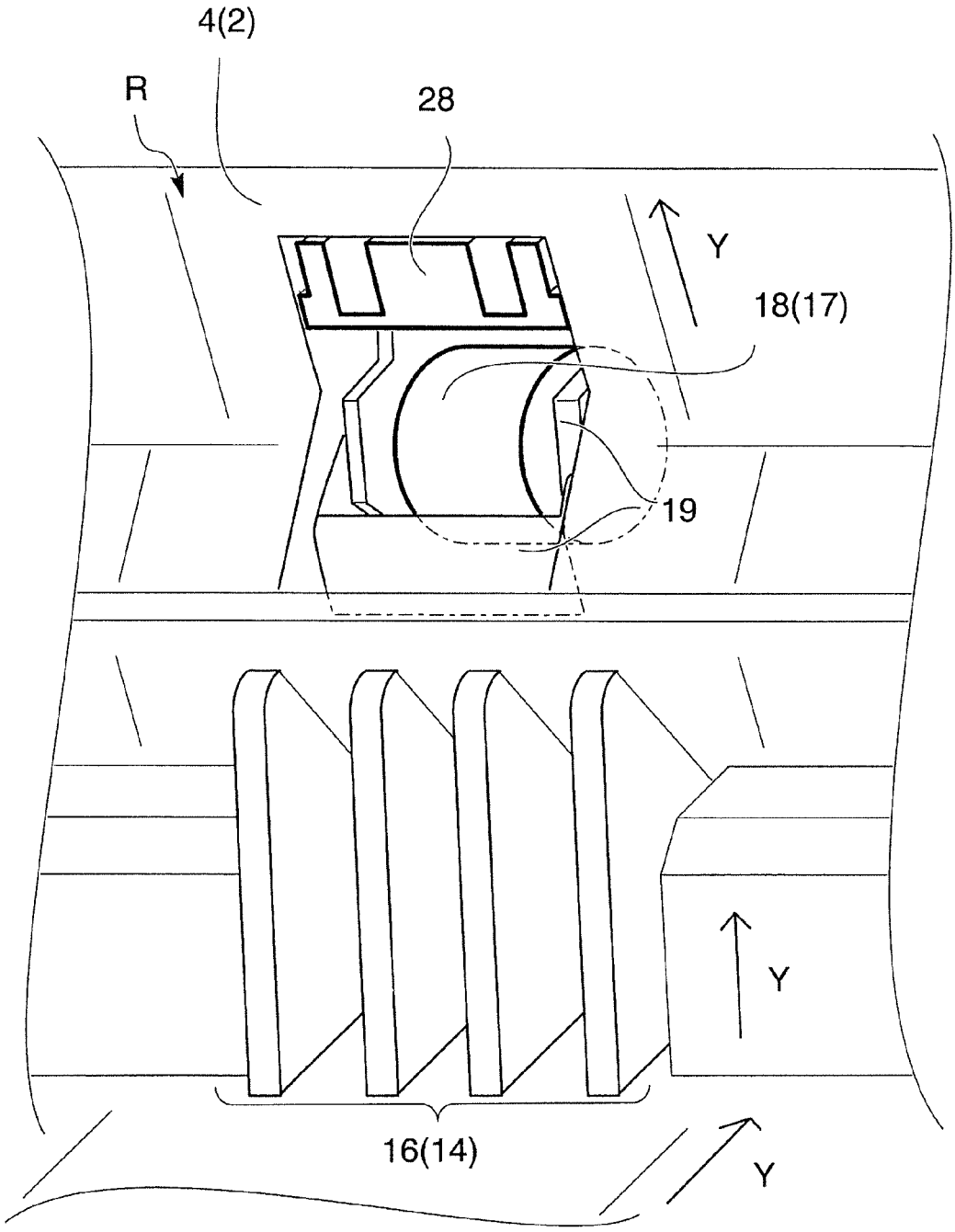
FIG. 6 is a perspective view showing a state of the second separating unit and the contact part (second separating mode, third state)

FIG. 6 is a perspective view showing a state of the second separating unit and the contact part in the third state according to the present invention. FIG. 7 is a side view showing a state of the second separating unit and the contact part in the third state according to the present invention.

In FIG. 6, the intermediate driving roller is not depicted so that the position of the retard roller 18 can be more easily understood.

Figure 7:
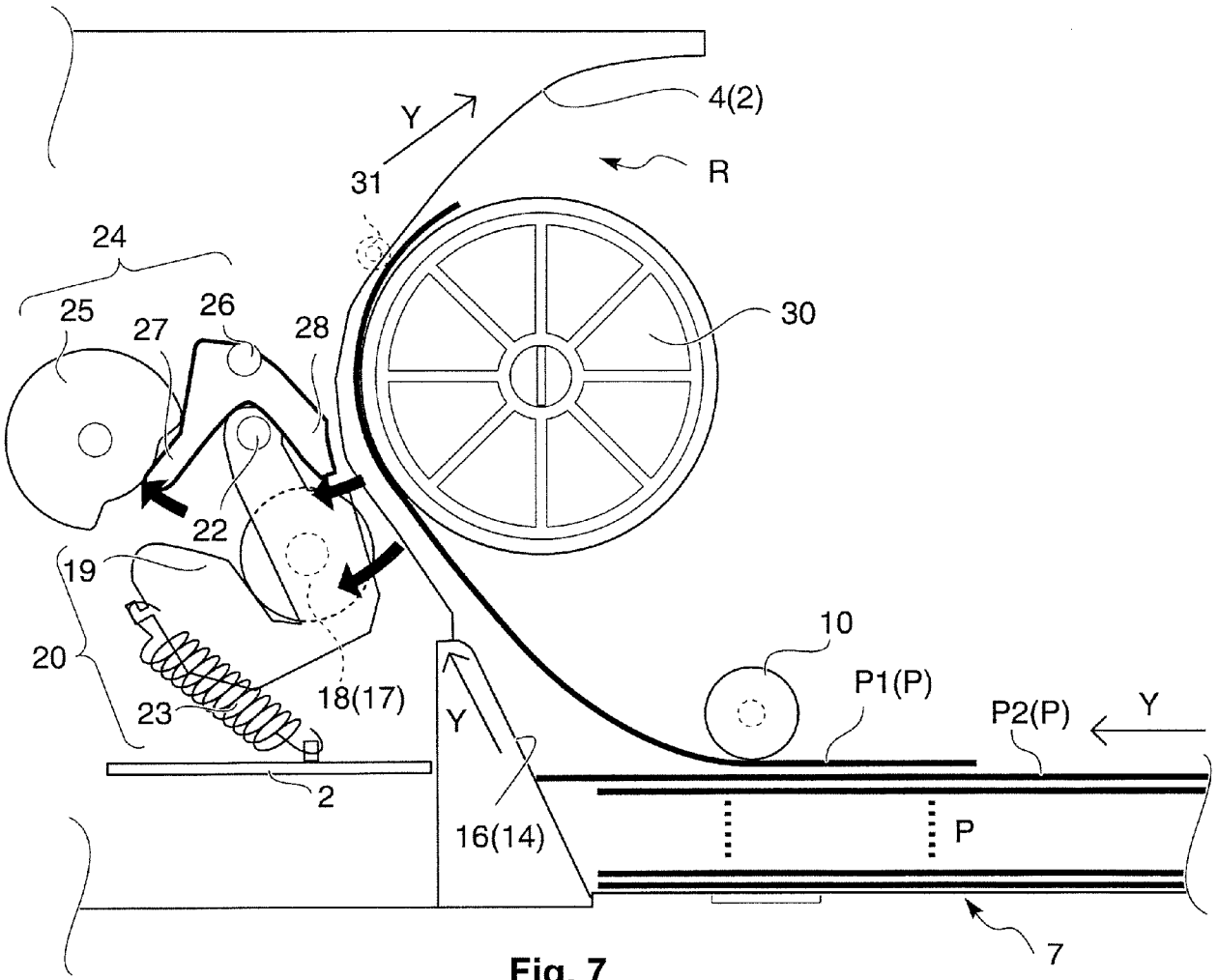
FIG. 7 is a side view showing a state of the second separating unit and the contact part (second separating mode, third state).

As shown in FIGS. 6 and 7, when the second separating mode is selected, the contact part 28 and the second separating unit 17 enter the third state.

In the present embodiment, a bottom surface of the paper sheet P placed on the cassette part 7, which is the placement part, is a surface that faces the recording head 43. Specifically, in the paper sheet P, a surface that comes into contact with the U-shaped external paper guide part 4 is a recording surface. Therefore, in an instance in which a high-quality recording is required, or in an instance in which a glossy photography paper is used or of other cases in which damage on the recording surface would create highly adverse events, it is necessary to prevent, as much as possible, the recording surface from being damaged. Also, in an instance in which the paper sheet is a non-glossy "matte sheet", there is a tendency of rubber dust from the retard roller 18 readily adhering when the paper sheet is pressed by the retard roller 18, and there is a need to prevent the rubber dust from adhering. The second separating mode is selected in such an instance.

Another possible configuration is one in which the selection is made automatically by a printer driver or the control part 44 of the printer 1 according to paper type. It shall be apparent that another possible configuration is one in which a user performs a selection operation.

A description will now be made for an operation when a selection has been switched from the first separating mode to the second separating mode. Specifically, the third motor 47 causes the first cam part (not shown) and the second cam part 25 to rotate. The force from the spring 23 causes the retard holder 19 to swing in the clockwise direction in FIG. 7. Therefore, the retard roller 18 can be made to move away from the intermediate driving roller 30.

As a result, it is possible to cancel a state in which the retard roller 18 and the intermediate driving roller 30 are capable of compressively holding the paper sheet P that has been fed. Specifically, a state in which the second separating unit 17 does not operate can be obtained.

Similarly, the contact part 28 is caused to swing, under its own weight, in the clockwise direction in FIG. 7. Specifically, it is possible to obtain a state in which the contact part 28 is in a state of being intimately aligned with a surface of the U-shaped external paper guide part 4, or a state of having retracted from the surface of the U-shaped external paper guide part 4.

When the pickup roller 10 feeds the paper sheet P downstream in the feed direction, the respective front edges of the plurality of paper sheets P1, P2 come into contact with the inclined surface 16 of the first separating unit 14.

In such an instance, the front edge of the paper sheet P1 in the uppermost position climbs along the inclined surface 16. Therefore, it is possible to separate the paper sheet P1 in the uppermost position from the subsequent paper sheets P2. The intermediate driving roller 30 and the second assist roller 31 can compressively hold, and feed further downstream, the paper sheet P1 in the uppermost position. Specifically, the paper sheet P1 in the uppermost position is not pressed by the retard roller 18. Also, there is no risk of an outside surface (i.e., the recording surface) of the paper sheet P1 in the uppermost position coming into concentrated contact with a top part of the contact part 28.

Therefore, it is possible to prevent the outside surface (i.e., the recording surface) of the paper sheet P1 in the uppermost position from being damaged. Also, in an instance in which matted paper is used, it is possible to prevent rubber dust from the retard roller 18 from adhering. As a result, the quality of the recording surface can be increased.

In the present embodiment, the retard roller 18 is made to swing to a position in which it is in a state of not protruding relative to the feed path R. However, the retard roller 18 may protrude slightly as long as the paper sheet P is not compressively held. This is because it is sufficient to obtain a state in which the second separating unit 17 does not operate. A reason for causing the retard roller 18 to swing to a position at which the retard roller 18 is in the state of not protruding in the present embodiment is to prevent the retard roller 18 from coming into contact with the paper sheet P. Rubber dust from the retard roller 18 can thereby be reliably prevented from adhering to the paper sheet P.

The medium-feeding unit 3 that is the medium-feeding device according to the present embodiment is characterized in comprising: the pickup part 9, which is the feeding unit for feeding the paper sheet P (an example of a fed medium) in the feed direction Y; the first separating unit 14 provided downstream in the feed direction relative to the pickup part 9, the first separating unit 14 being capable of separating the paper sheet P that has been multi-fed; the second separating unit 17 provided downstream relative to the first separating unit 14, the second separating unit 17 being capable of switching between a state in which the paper sheet P that has been fed is compressively held, and a state in which the compressive holding is released, the applying of the compressive holding causing separation of a multi-fed paper sheet P2 in an instance in which multi-feeding has occurred; and the contact part 28 provided downstream relative to the second separating unit 17, the contact part 28 being capable of switching between a state of protruding and a state of not protruding relative to the feed path R for guiding the paper sheet P, the contact part 28 coming into contact, while in the protruding state, against the front edge of the paper sheet P2 that has been separated by the second separating unit 17, and restricting movement of the paper sheet P2 downstream. The medium-feeding device has: the first separating mode, in which separation is performed using the first separating unit 14, the second separating unit 17, and the contact part 28; and the second separating mode, in which separation is performed using the first separating unit 14 without using the second separating unit 17 or the contact part 28; switching between the first separating mode and the second separating mode capable of being performed.

The medium-feeding unit 3 according to the present embodiment is characterized in comprising: the pickup part 9 for feeding the paper sheet P in the feed direction Y; the first separating unit 14 provided downstream in the feed direction relative to the pickup part 9, the first separating unit 14 being capable of separating the paper sheet P that has been multi-fed; the second separating unit 17 provided downstream relative to the first separating unit 14, the second separating unit 17 being capable of switching between a state in which the paper sheet P that has been fed is compressively held, and a state in which the compressive holding is released, the applying of the compressive holding causing separation of a multi-fed paper sheet P2 in an instance in which multi-feeding has occurred; and the contact part 28 provided downstream relative to the second separating unit 17, the contact part 28 being capable of switching between a state of protruding and a state of not protruding relative to the feed path R for guiding the paper sheet P, the contact part 28 coming into contact, while in the protruding state, against the front edge of the paper sheet P2 that has been separated by the second separating unit 17, and restricting movement of the paper sheet P2 downstream. It is possible to switch between the first state, in which the second separating unit 17 is in the compressively held state and the contact part 28 is in the protruding state; the second state, in which the second separating unit 17 is in the released state and the contact part 28 is in the protruding state; and the third state, which the second separating unit 17 is in the released state and the contact part 28 is in the retracted state.

The present embodiment is characterized in further having the second cam part 25 and the cam follower part 27, as the cam mechanism for switching the contact part 28 between the protruding state and the retracted state, wherein the second cam part 25 is configured so as to be capable of maintaining the protruding state of the contact part 28.

Also, the present embodiment is characterized in that the second separating unit 17 has the intermediate driving roller 30 as the driving roller for driving and a retard roller 18, the retard roller provided so as to be capable of performing an approaching/retracting movement relative to the driving roller 30 and requiring a predetermined load in order to rotate; the contact part 28 is provided on a side of the feed path R on which the retard roller 18 is provided with respect to the paper sheet P; and a section R1 of the feed path R in a section R1 between the pickup roller 10 of the pickup part 9 and the contact part 28 is of a curved configuration so that a side on which the retard roller 18 and the contact part 28 are provided is disposed at an outside of an arc.

The printer 1, which is the recording device according to the present invention, is characterized in comprising medium-feeding unit 3 for sending the paper sheet P, which is an example of a recording medium, in the feed direction Y; and a recording part 41 for making a recording, using a recording head 43, on the paper sheet P that has been fed by the medium-feeding unit 3.

It shall be apparent that the present invention is not limited in scope by the above embodiment, that a variety of modifications are possible within the scope of the invention described in the claims, and that such modifications are also included in the scope of the present invention.

General Interpretation of Terms

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Finally, terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents.

What is claimed is:

1. A medium-feeding device comprising:

a feeding unit configured to feed a fed medium in a feed direction;

a first separating unit provided downstream in the feed direction relative to the feeding unit, the first separating unit being configured to separate a multi-fed medium that has been multi-fed;

a second separating unit provided downstream relative to the first separating unit, the second separating unit having a driving roller and a retard roller configured to perform an approaching/retracting movement relative to the driving roller, the second separating unit being configured to separate a multi-fed medium; and a contact part provided downstream relative to the second separating unit, the contact part being configured to restrict movement of the multi-fed medium towards downstream by contacting a front edge of the multi-fed medium, a length of the contact part in a direction which intersects the feeding direction being longer than a length of the retard roller in the direction which intersects the feeding direction, the contact part having a flat contact surface portion that is configured to contact the multi-fed medium, the flat contact surface portion and the retard roller being aligned in the feeding direction with respect to each other.

2. The medium-feeding device according to claim 1, wherein the medium-feeding device includes a first state in which separation of the multi-fed medium is performed using the first separating unit, the second separating unit, and the contact part, a second state in which separation of the multi-fed medium is performed using the first separating unit and the contact part, and a third state in which separation of the multi-fed medium is performed using the first separating unit without using the second separating unit and the contact part.

3. The medium-feeding device according to claim 1, further comprising a cam mechanism configured to switch between a protruding state and a retracted state of the contact part, the cam mechanism being configured to selectively maintain the protruding state of the contact part.

4. The medium-feeding device according to claim 1, wherein the contact part and the retard roller are disposed on a same side of a feed path with respect to the driving roller, and a section of the feed path between the feeding unit and the contact part has a curved configuration so that the side on which the retard roller and the contact part are provided is disposed at an outside of an arc.

5. The medium-feeding device according to claim 2, wherein the feeding unit starts feeding of the fed medium when the medium-feeding device is the first state.

6. The medium-feeding device according to claim 5, wherein the feeding unit starts feeding of the fed medium when the medium-feeding device is the third state.

7. A recording device comprising:

a medium-feeding unit including the medium-feeding device according to claim 1 to feed a recording medium in the feed direction; and a recording part configured to perform recording, using a recording head, on the recording medium that has been fed by the medium-feeding unit.

8. A recording device comprising:

a medium-feeding unit including the medium-feeding device according to claim 2 to feed a recording medium in the feed direction; and a recording part configured to perform recording, using a recording head, on the recording medium that has been fed by the medium-feeding unit.

9. A recording device comprising:

a medium-feeding unit including the medium-feeding device according to claim 3 to feed a recording medium in the feed direction; and a recording part configured to perform recording, using a recording head, on the recording medium that has been fed by the medium-feeding unit.

10. A recording device comprising:

a medium-feeding unit including the medium-feeding device according to claim 4 to feed a recording medium in the feed direction; and a recording part configured to perform recording, using a recording head, on the recording medium that has been fed by the medium-feeding unit.

11. A recording device comprising:

a medium-feeding unit including the medium-feeding device according to claim 5 to feed a recording medium in the feed direction; and a recording part configured to perform recording, using a recording head, on the recording medium that has been fed by the medium-feeding unit.

12. A recording device comprising:

a medium-feeding unit including the medium-feeding device according to claim 6 to feed a recording medium in the feed direction; and a recording part configured to perform recording, using a recording head, on the recording medium that has been fed by the medium-feeding unit.

* * * * *